US006782575B1

(12) United States Patent
Robinson

(10) Patent No.: US 6,782,575 B1
(45) Date of Patent: Aug. 31, 2004

(54) MATTRESS CORE AND MATTRESS PROVIDING PRESSURE RELIEF AND MINIMIZING BODY PRESSURE

(75) Inventor: Rick D. Robinson, Tampa, FL (US)

(73) Assignee: Steven J. Antinori, Tampa, FL (US)

( * ) Notice: Subject to any disclaimer, the term of this patent is extended or adjusted under 35 U.S.C. 154(b) by 0 days.

(21) Appl. No.: 10/655,016

(22) Filed: Sep. 5, 2003

(51) Int. Cl.[7] ..... A47C 27/16; A47C 27/15
(52) U.S. Cl. ..... 5/740; 5/736; 5/739; 5/727
(58) Field of Search ..... 5/727, 731, 736, 5/739, 740, 944, 655.9, 953

(56) References Cited

U.S. PATENT DOCUMENTS

| | | | |
|---|---|---|---|
| 3,118,153 A | 1/1964 | Hood | |
| 3,210,781 A | 10/1965 | Pollock | |
| 3,521,311 A | 7/1970 | Cohen | |
| 3,774,250 A | 11/1973 | Miller | |
| 3,939,508 A | 2/1976 | Hall et al. | |
| 4,042,987 A | 8/1977 | Rogers | |
| 4,086,675 A | 5/1978 | Talbert et al. | |
| 4,143,435 A | 3/1979 | Masuda | |
| 4,673,452 A | 6/1987 | Awdhan | |
| 4,975,996 A | 12/1990 | Evans et al. | |
| 4,999,868 A | 3/1991 | Kraft | |
| 5,022,111 A | 6/1991 | Fenner, Sr. | |
| 5,136,740 A | 8/1992 | Kraft | |
| 5,138,730 A | 8/1992 | Masuda | |
| 5,172,436 A | 12/1992 | Masuda | |
| 5,353,455 A | 10/1994 | Loving et al. | |
| 5,636,397 A | 6/1997 | Boyd et al. | |
| 5,701,623 A | 12/1997 | May | |
| 6,202,239 B1 | 3/2001 | Ward et al. | |
| 6,237,173 B1 * | 5/2001 | Schlichter et al. | 5/722 |

FOREIGN PATENT DOCUMENTS

| | | | |
|---|---|---|---|
| GB | 2274054 A * | 7/1994 | A47C/27/14 |

* cited by examiner

*Primary Examiner*—Robert G. Santos
(74) *Attorney, Agent, or Firm*—Diller, Ramik & Wight

(57) ABSTRACT

A mattress core is defined by a base core to which is bonded upper and lower corrugated outer layers each having oppositely directed corrugations, and side rails bonded to at least sides of the base core. The side rails have a height corresponding to the distance between valleys of opposite corrugated outer layers. The mattress core and mattress have an ILD range of substantially 26 ILD to 50 ILD for the side rails, 24 to 40 ILD for the base core and 12 to 45 ILD for each of the corrugated outer layers. The base core and the outer layers also collectively define a torso firmness zone and opposite head and foot firmness zones with the torso firmness zone being substantially between 20% to 30% more dense than the head and foot firmness zones. Ends of the mattress core and mattress are devoid of end rails.

24 Claims, 4 Drawing Sheets

MATTRESS CORE AND MATTRESS PROVIDING PRESSURE RELIEF AND MINIMIZING BODY PRESSURE

BACKGROUND OF THE INVENTION

This invention is directed to a mattress core and a mattress formed therefrom. Typical of such conventional structures is that disclosed in the patent to Awdhan (U.S. Pat. No. 4,673,452) which discloses a central polyurethane foam core and opposite convoluted layers with the entire mattress being bounded by side pieces and end pieces in the form of a conventional so-called racetrack mattress. The entirety of the mattress and mattress core is constructed from synthetic polymeric/copolymeric plastic material.

Another typical mattress is that disclosed in the patent to May (U.S. Pat. No. 5,701,623) which includes a center core of latex foam rubber having a generally polygonal outline defined by relatively short parallel foot and head faces and relatively longer parallel side faces. A border is formed by four border sections with side border sections being bonded to the side faces of the core and foot and head border sections being bonded to respective foot and head faces of the core. Opposite end faces of the side border sections are overlapped by the respective head and foot border sections. The border sections are preferably constructed from urethane foam having a range of density or Initial Load Deflection (ILD) less than the density or the ILD of the latex foam rubber of the core which results in a border of a mattress being firmer than the center core.

The latter mattress cores/mattresses provide certain advantages yet neither or a combination thereof seemingly achieves the most important characteristic desired in a mattress, particularly a mattress associated with healthcare installations, such as hospitals, nursing homes, etc., which is the minimization of body pressure, such as would provide pressure relief which would maximize capillary blood flow and/or prevent bed sores.

The patent to Boyd et al. (U.S. Pat. No. 5,636,397) discloses a futon mattress which includes two convoluted sections, as in the Awdhan patent, but rails are disclosed only at ends of the convoluted sheets or layers. However, this patent and the others mentioned reference desirability of different materials for different components of the mattress which has different density and/or ILD ranges, as well as convoluted and/or non-convoluted plies or layers to achieve desired firmness or zoned areas of firmness. Further examples of such mattress/mattress core constructions can be found in the following patents:

Hood U.S. Pat. No. 3,118,153
Pollock U.S. Pat. No. 3,210,781
Cohen U.S. Pat. No. 3,521,311
Miller U.S. Pat. No. 3,774,250
Hall et al. U.S. Pat. No. 3,939,508
Rogers U.S. Pat. No. 4,042,987
Talbert et al. U.S. Pat. No. 4,086,675
Masuda U.S. Pat. No. 4,143,435
Evans et al. U.S. Pat. No. 4,975,996
Kraft U.S. Pat. No. 4,999,868
Fenner. Sr. U.S. Pat. No. 5,022,111
Kraft U.S. Pat. No. 5,136,740
Masuda U.S. Pat. No. 5,138,730
Masuda U.S. Pat. No. 5,172,436

Loving et al. U.S. Pat. No. 5,353,455
Ward U.S. Pat. No. 6,202,239 B1

BRIEF SUMMARY OF THE INVENTION

A mattress core or mattress constructed in accordance with this invention includes a center core of a generally polygonal configuration formed of latex foam and upper and lower latex foam outer layers of latex foam having exterior convoluted surfaces defined by peaks and valleys. The outer layers are bonded to the base core and a polyurethane foam side rail is located one along each base core and side surfaces of the upper and lower layers. The side rails are bonded to at least one of the base core and the outer layer side surfaces and each side rail preferably has a height corresponding substantially to the distance between valleys of convolutions of the opposite outer layers. The ends of the base core and the outer layers define terminal end surfaces of the mattress core/mattress which are devoid of any rails.

Preferably the mattress core/mattress have an ILD range of substantially 26 ILD to 50 ILD for the side rails, 24 to 40 ILD for the base core and 12 to 45 ILD for each of the outer layers.

The base core and the outer layers also collectively define a torso firmness zone and opposite head and foot firmness zones with the torso firmness zone being substantially between 20 percent (20%) to 30 percent (30%) more dense than the head and foot firmness zones.

With the above and other objects in view that will hereinafter appear, the nature of the invention will be more clearly understood by reference to the following detailed description, the appended claims and the several views illustrated in the accompanying drawings.

DETAILED DESCRIPTION OF THE INVENTION

Figure 1:
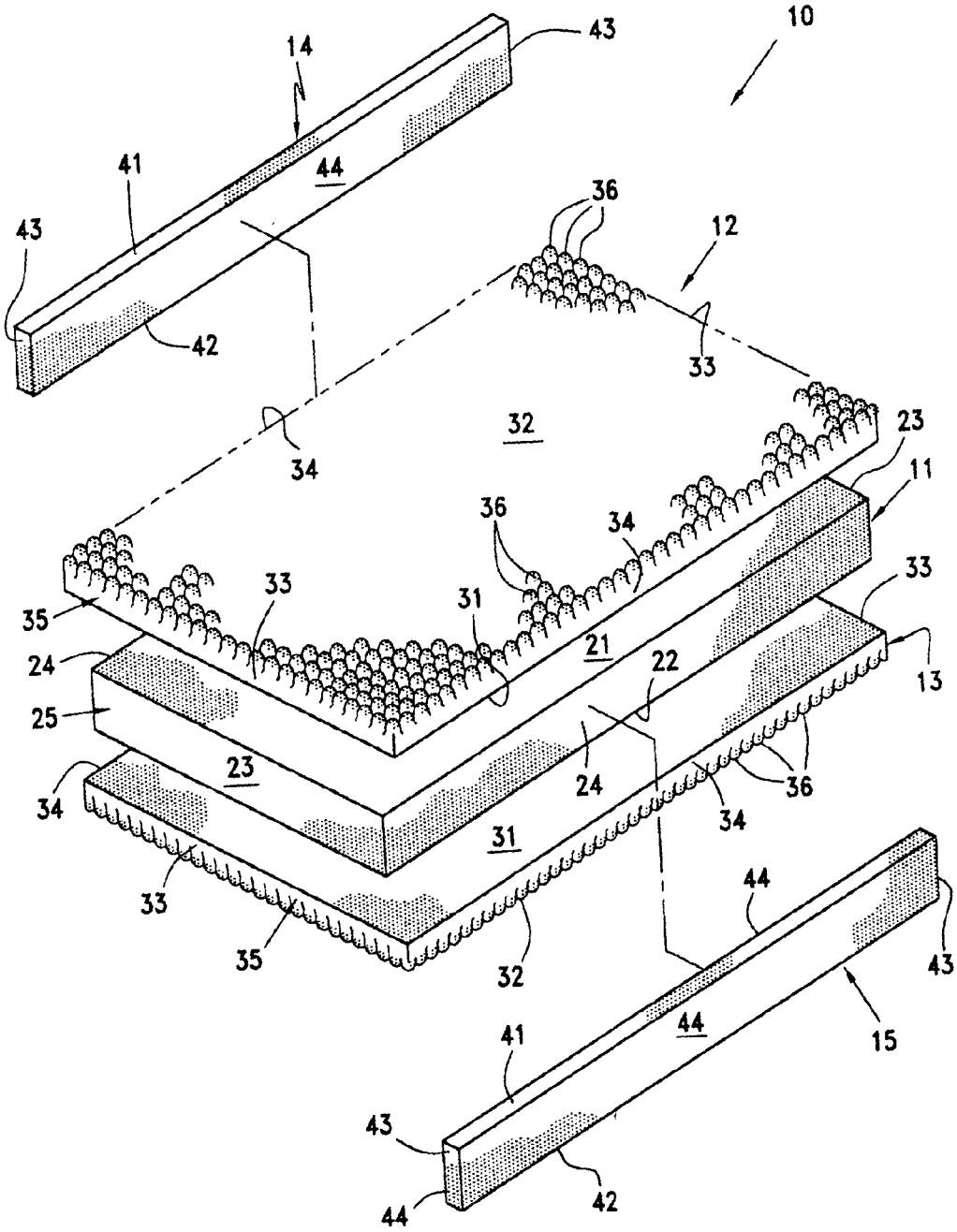
FIG. 1 is a perspective exploded view of a mattress core constructed in accordance with this invention prior to the assembly thereof, and illustrates a base core, opposite upper and lower outer layers having opposite convoluted surfaces and opposite side rails.

A novel mattress core constructed in accordance with this invention is fully illustrated in FIG. 1 of the drawings and is generally designated by the reference numeral 10.

The mattress core 10, when assembled as will be described more fully herein, is utilized to manufacture a novel mattress 20 (FIGS. 2 through 4) of the invention.

The mattress core 10 (FIGS. 1 through 4) includes a substantially polygonal latex foam base core 11, first and second substantially polygonal latex foam upper and lower outer layers 12, 13, respectively, and opposite substantially parallel polyurethane foam side rails 14, 15.

The base core 11 has opposite substantially parallel upper and lower uniplanar or flat surfaces 21, 22, respectively, identical substantially parallel opposite end surfaces 23, 23 and opposite substantially parallel side surfaces 24, 24. The end surfaces 23, 23 and side surfaces 24, 24 define a substantially polygonal peripheral surface 25 of the base core 11. The latex foam base core 11 is substantially 3.6 inches in height or thickness, as measured between the surfaces 21, 22, has an Initial Load Deflection (ILD) range of 24 ILD–50 ILD (preferably 24 ILD–40 ILD) and a center one-third between the end surfaces 23, 23 has a latex zoning ratio of 20 percent (20%)–30 percent (30%) denser than each of the opposite one-third head and foot ends (unnumbered) of the base core 11.

Each of the first and second substantially polygonal latex foam upper and lower outer layers 12, 13, respectively, is identical and includes a substantially flat uniplanar surface 31, 31, opposite convoluted surfaces 32, 32, spaced substantially parallel end surfaces 33, 33 and spaced substantially parallel side surfaces 34, 34. The end surfaces 33, 33 and side surfaces 34, 34 of each of the outer layers 12, 13 define a polygonal peripheral surface 35 corresponding in length, width and overall area to the polygonal peripheral surface 25 of the base core 11. The peaks of the corrugated outer layers 12, 13 are each identified by the reference character 36 and the valleys by reference character 37 with the distance between the valleys 37 of the opposite outer layers 12, 13 when fully assembled (FIGS. 2 through 4) being designated by the distance Dv (FIG. 3). Each of the outer layers has a height of 1.9 inch as measured between the opposite surfaces 31, 32, and an Initial Load Deflection (ILD) range of substantially 12 ILD–45 ILD with a latex zoning ratio of the center third being 20 percent (20%)–30 percent (30%) more dense than at opposite ends which essentially matches the zoning ratio heretofore described with respect to the base core 11. While the overall height or depth of the outer layers 12, 13 is approximately 1.9 inches, as is indicated by the reference character Hl (FIG. 3), the height of each corrugation and valley, Hc and Hv, respectively, is approximately 0.9 inch, while the base height Hb is approximately 1.0 inch.

Each polyurethane foam side rail or side bar 14, 15 includes upper and lower substantially parallel surfaces 41, 42, respectively, substantially parallel end surfaces 43, 43 and substantially parallel side surfaces 44, 44. Each polyurethane foam side rail 14, 15, has an Initial Load Deflection (ILD) range of substantially 26 ILD–50 ILD. As compared to the base core 11 and the outer layers 12, 13, the side rails 14, 15 are not zoned but instead are of a substantial uniform density throughout (preferably an ILD range of 26 ILD–50 ILD).

Figure 2:
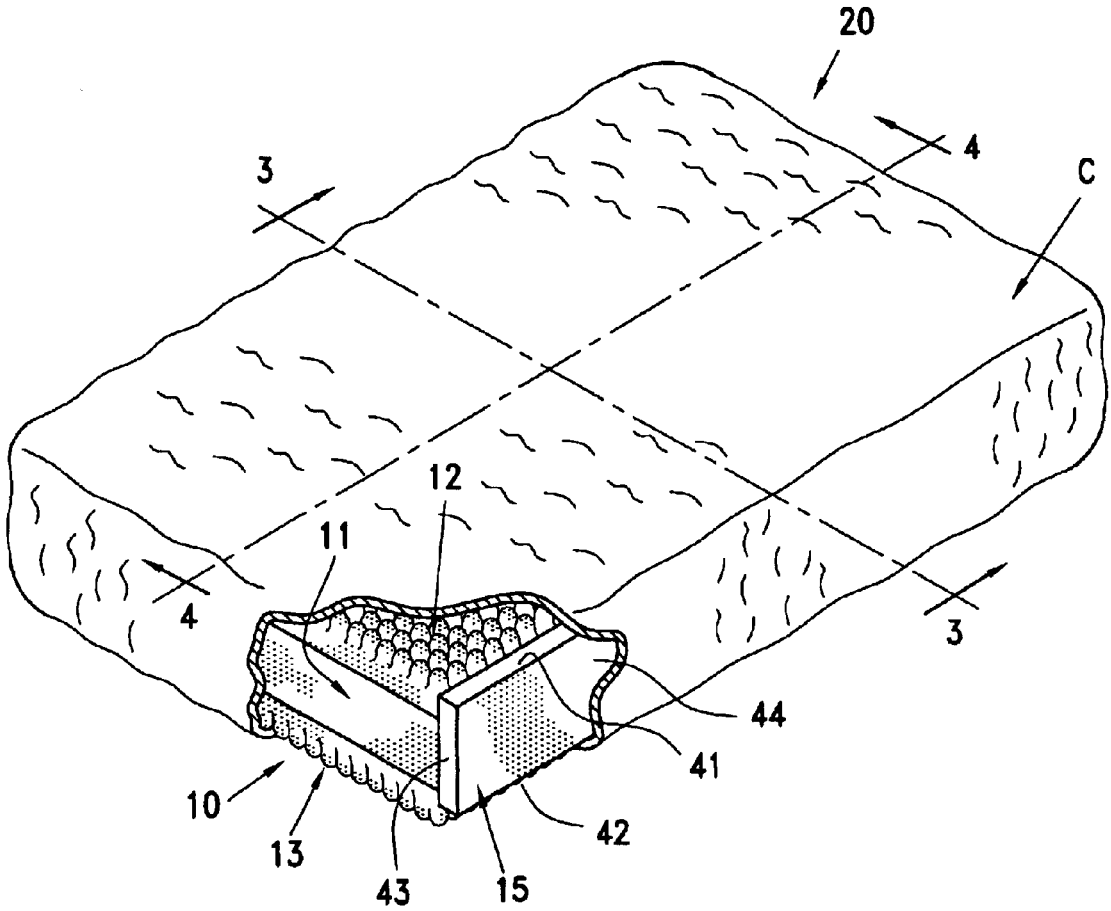
FIG. 2 is a fragmentary perspective view of a mattress of the invention, and illustrates the assembled mattress core of FIG. 1 and a quilted cover encasing the same.
Figures 3, 4:
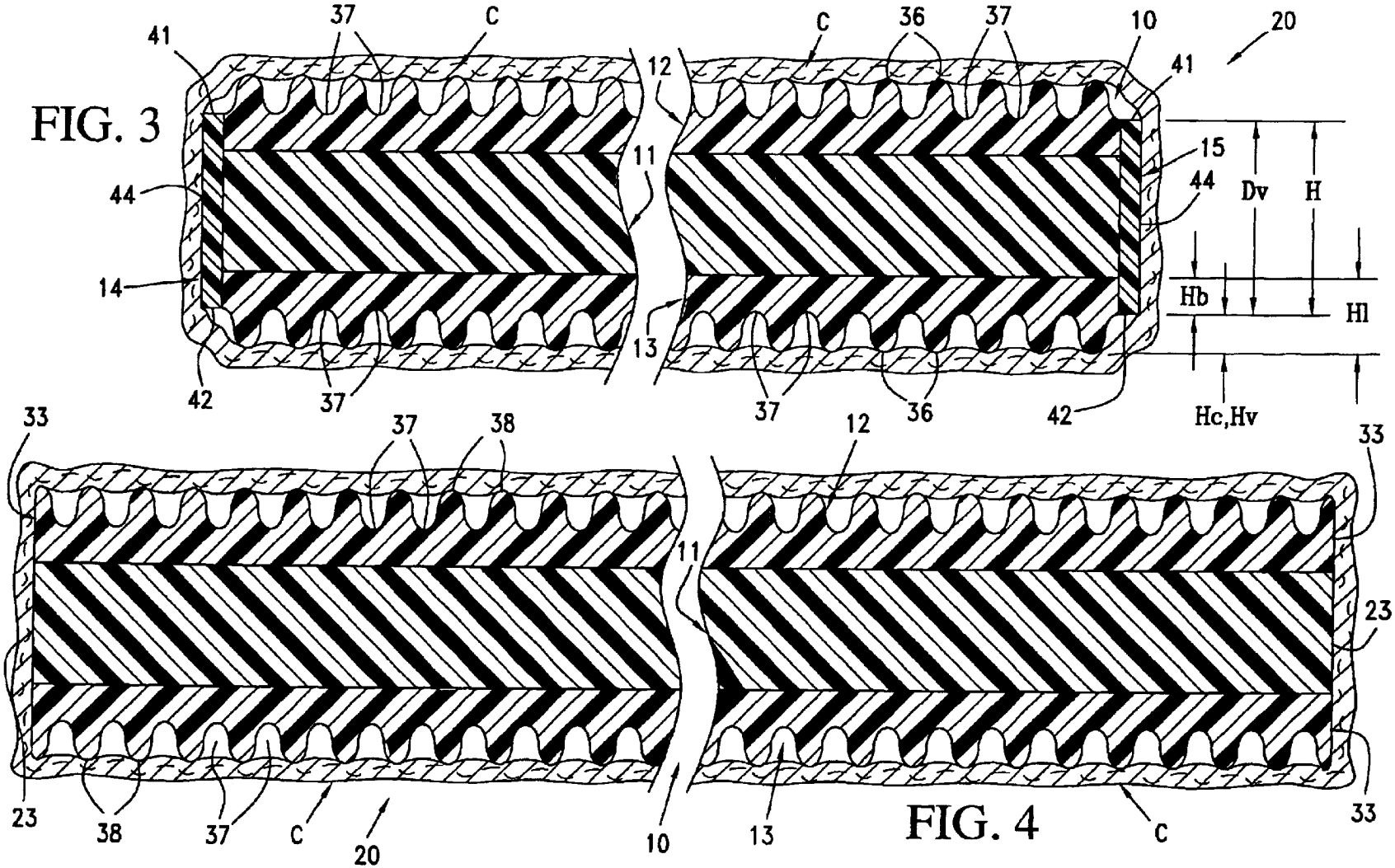
FIG. 3 is an enlarged fragmentary transverse cross-sectional view taken generally along line 3—3 of FIG. 2, and illustrates details of the mattress including the height of one of the side rails corresponding substantially to the distance between the valleys of the opposite corrugated layers.
FIG. 4 is an enlarged fragmentary longitudinal cross-sectional view taken generally along line 4—4 of FIG. 2, and illustrates the absence of rails at head and foot ends of the mattress core and the upper and lower corrugated outer layers.

The base core 11, the outer layers 12, 13 and the side rails 14, 15 (FIG. 1) are assembled to form the assembled mattress core 10 of FIGS. 2 through 4 by placing the lower outer layer 13 upon an assembly table, spraying an adhesive (not shown) upon the surface 31 of the outer layer 13, seating the surface 22 of the base core 11 thereupon with the peripheral surfaces 25, 35 aligned, spraying adhesive upon the surface 21 of the base core 11, and seating the surface 31 of the outer layer 12 upon the upper surface 21 of the base core 11, again with the peripheral surfaces 25, 35 aligned. Thereafter, adhesive is applied to the surfaces 44, 44 and/or 24, 24 and 34, 34 after which the same are brought into adhesive contact/bonding relationship resulting in the bonded/assembled mattress core 10 (FIGS. 2–5). It is to be particularly noted from FIG. 3 that the distance Dv between the valleys 37, 37 of the opposite outer layers 12, 13 corresponds to the height H (FIG. 3) between the surfaces 41, 42 of each of the side rails 14, 15. The latter provides firmer edge support for the approximate two-thirds (⅔) of a person's weight seated upon the mattress edge as might occur when a patient sits upon the mattress edge to tie his/her shoes, a visitor sits upon the mattress edge when visiting a patient resting thereon, etc.

After complete assembly/bonding of the base core 10, the entirety thereof is encapsulated in a conventional quilted outer covering C (FIGS. 2 through 4) thereby completing the construction of the mattress 20.

Figure 5:
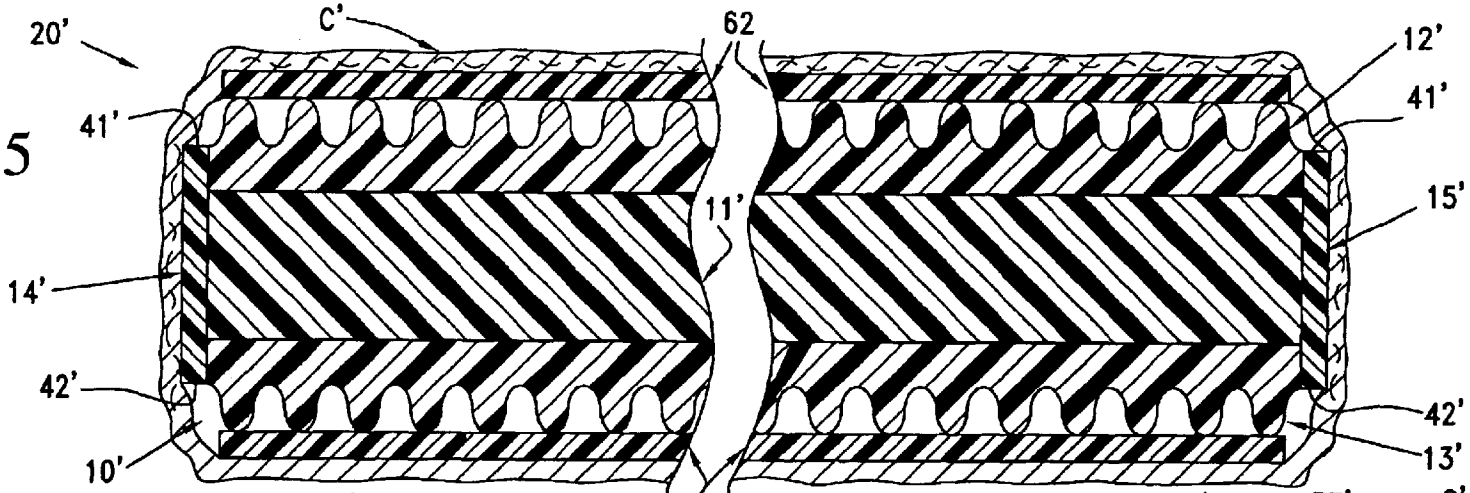
FIG. 5 is a fragmentary transverse cross-sectional view of another mattress substantially identical to the mattress of FIG. 3, and illustrates an additional layer of synthetic polymeric/copolymeric material sandwiched between each of the outer corrugated layers and the quilted cover.
Figure 6:
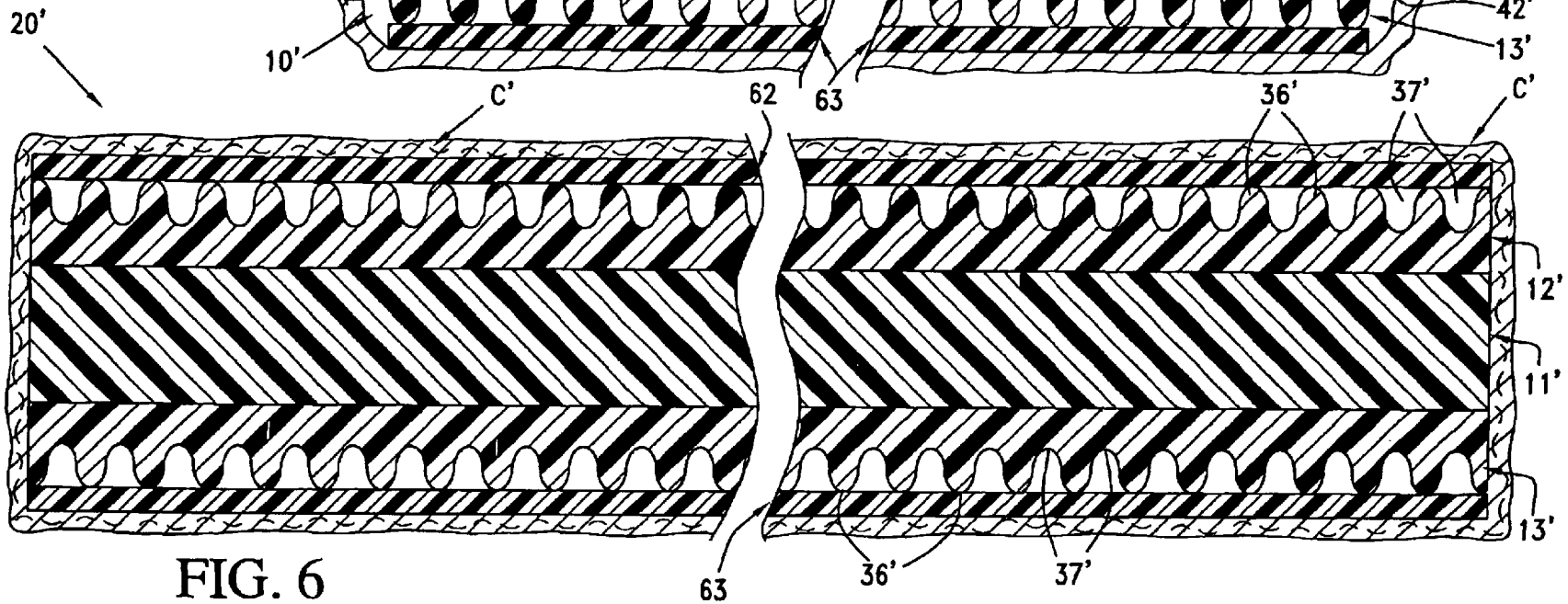
FIG. 6 is an enlarged fragmentary longitudinal cross-sectional view similar to FIG. 4, and illustrates the details of the head and foot ends of the mattress of FIG. 5.

Another mattress core constructed in accordance with this invention and an associated mattress formed thereof are illustrated in FIGS. 5 and 6 of the drawings and are generally designated by the respective reference numerals 10', 20' to designate identical components, materials, thicknesses, ILD ranges, densities, etc. The mattress cores 10, 10' are identical but in the mattress 20' (FIGS. 5 and 6) upper and lower polymeric/copolymeric layers 62, 63, preferably formed of latex foam, are adhesively bonded to the peaks 36' of the corrugated outer layers 12', 13' to render the overall mattress 20' somewhat firmer than the mattress 20 while at the same time providing minimized body pressure and/or maximum capillary blood flow and/or the prevention of bed sores in conjunction with the combination of materials, ranges of ILD, etc., heretofore described.

Although a preferred embodiment of the invention has been specifically illustrated and described herein, it is to be understood that minor variations may be made in the apparatus without departing from the spirit and scope of the invention, as defined by the appended claims.

What is claimed is:

1. A mattress core comprising a substantially polygonal latex foam base core having opposite substantially parallel end surfaces and opposite substantially parallel side surfaces collectively defining a polygonal peripheral surface, first and second substantially polygonal latex foam outer layers each having opposite substantially parallel end surfaces and opposite substantially parallel side surfaces collectively defining a substantially polygonal peripheral surface of each outer layer which substantially match the base core polygonal peripheral surface, said base core having opposite substantially flat surfaces and said outer layers each having a substantially flat surface and an opposite substantially convoluted surface defined by peaks and valleys, means for bonding first and second of said outer layers substantially flat surfaces to respective first and second ones of said base core substantially flat surfaces with said polygonal peripheral surfaces being in substantially peripherally aligned relationship, a polyurethane foam side rail located one along each base core and layer side surfaces and each extending substantially between said base core end surfaces, means for bonding said side rails each to at least one of said base core and outer layers side surfaces, each side rail having a height corresponding substantially to the distance between valleys of convolutions of the opposite outer layers, and said base core and outer layers end surfaces defining terminal end surfaces of the mattress.

2. The mattress core as defined in claim 1 wherein each of said base core and outer layers each include an ILD range, and a low side of the ILD range of said layers is outside a low side of the ILD range of said base core.

3. The mattress core as defined in claim 1 wherein said base core and layers collectively define a torso firmness zone and opposite head and foot firmness zones, and said torso firmness zone is substantially between 20% to 30% more dense than at least one of said head and foot firmness zones.

4. The mattress core as defined in claim 1 wherein said side rails have an ILD range of substantially 26 ILD to 50 ILD.

5. The mattress core as defined in claim 1 wherein said base core has an ILD range of substantially between 24 to 50 ILD.

6. The mattress core as defined in claim 1 wherein each of said outer layers has an ILD range of substantially between 12–45 ILD.

7. The mattress core as defined in claim 1 wherein the total thickness of said outer layers is substantially equal to the thickness of said base core.

8. The mattress core as defined in claim 1 wherein the total thickness of said outer layers is greater than the thickness of said base core.

9. The mattress core as defined in claim 1 wherein the height of each side rail corresponds substantially to the distance between the valleys of said outer layers.

10. The mattress core as defined in claim 1 wherein each outer layer includes a base portion defined by substantially parallel planes passing one through bases of said valleys and another through said outer layer substantially flat surfaces, and the ratio of the height of the peaks and valleys to the base portion of at least one of said outer layers is substantially 2 to 1.

11. The mattress core as defined in claim 1 including at least one further layer having an outer peripheral surface corresponding to said outer layer peripheral surfaces, and said at least one further layer being disposed upon peaks of corrugations of one of said outer layers.

12. The mattress core as defined in claim 1 including at least one further layer having an outer peripheral surface corresponding to said outer layer peripheral surfaces, said at least one further layer being disposed upon peaks of corrugations of one of said outer layers, and a quilted covering substantially encapsulating said mattress core thereby defining a mattress.

13. The mattress core as defined in claim 2 wherein said side rails have an ILD range of substantially 26 ILD to 50 ILD.

14. The mattress core as defined in claim 2 wherein said base core has an ILD range of substantially between 24 to 50 ILD.

15. The mattress core as defined in claim 2 wherein each of said outer layers has an ILD range of substantially between 12–45 ILD.

16. The mattress core as defined in claim 3 wherein said side rails have an ILD range of substantially 26 ILD to 50 ILD.

17. The mattress core as defined in claim 3 wherein said base core has an ILD range of substantially between 24 to 50 ILD.

18. The mattress core as defined in claim 3 wherein each of said outer layers has an ILD range of substantially between 12–45 ILD.

19. The mattress core as defined in claim 4 wherein said base core has an ILD range of substantially between 24 to 50 ILD.

20. The mattress core as defined in claim 5 wherein each of said outer layers has an ILD range of substantially between 12–45 ILD.

21. The mattress core as defined in claim 13 wherein said base core and layers collectively define a torso firmness zone and opposite head and foot firmness zones, and said torso firmness zone is substantially between 20% to 30% more dense than at least one of said head and foot firmness zones.

22. The mattress core as defined in claim 14 wherein said base core and layers collectively define a torso firmness zone and opposite head and foot firmness zones, and said torso firmness zone is substantially between 20% to 30% more dense than at least one of said head and foot firmness zones.

23. The mattress core as defined in claim 15 wherein said base core and layers collectively define a torso firmness zone and opposite head and foot firmness zones, and said torso firmness zone is substantially between 20% to 30% more dense than at least one of said head and foot firmness zones.

24. The mattress core as defined in claim 19 wherein each of said outer layers has an ILD range of substantially between 12–45 ILD.

* * * * *